United States Patent [19]

Borodin et al.

[11] 4,194,538

[45] Mar. 25, 1980

[54] WEFT THREAD GRIPPING MECHANISM FOR A LOOM WITH A TRAVELLING-WAVE SHED AND A DISK-TYPE BEAT-UP MOTION

[76] Inventors: Valerian A. Borodin, ulitsa Gubkina, 4, kv. 74; Lidia M. Sudakova, Dubninskaya ulitsa, 10, korpus 5, kv. 38; Nikolai I. Kolobanov, Leninsky prospekt, 94a, kv. 54, all of Moscow, U.S.S.R.

[21] Appl. No.: 2,014

[22] Filed: Jan. 8, 1979

[51] Int. Cl.[2] ..... D03D 47/26

[52] U.S. Cl. ..... 139/194; 139/436; 139/302

[58] Field of Search ..... 139/11, 13 R, 194, 195, 139/302

[56] References Cited

U.S. PATENT DOCUMENTS

| | | | |
|---|---|---|---|
| 3,845,790 | 11/1974 | Filter et al. | 139/194 |
| 3,851,679 | 12/1974 | Titov et al. | 139/194 |
| 3,908,710 | 9/1975 | Mullekom | 139/194 |
| 4,071,051 | 1/1978 | Strauss | 139/194 X |

*Primary Examiner*—Henry Jaudon

*Attorney, Agent, or Firm*—Steinberg and Blake

[57] ABSTRACT

The proposed weft-thread gripping mechanism includes gripping members elastically tightened together and installed at the side of exit of weft thread carriers from a travelling-wave shed. The gripping members, one of which is movable relative to the other one, are mounted on a shaft of a disk-type beat-up motion so as to be rotatable therewith and displaceable, after gripping the weft thread, lengthwise the shaft axis in the direction from the travelling-wave shed. Located on the shaft of the disk-type beat-up motion is a stationary stop cooperating with the movable gripping member at the moment of the closest approach of the gripping members to the travelling-wave shed for a gap to be formed therebetween a weft thread passes through. This makes it possible to keep taut the weft thread advanced to the fell of the cloth till the end of the process of the cloth formation.

8 Claims, 9 Drawing Figures

WEFT THREAD GRIPPING MECHANISM FOR A LOOM WITH A TRAVELLING-WAVE SHED AND A DISK-TYPE BEAT-UP MOTION

FIELD OF THE INVENTION

The present invention relates to looms with a travelling-wave shed and, more particularly, to weft thread gripping mechanisms for looms with a travelling-wave shed and a disk-type beat-up motion, wherein the disks are secured on the shaft.

BACKGROUND OF THE INVENTION

In the loom with the travelling-wave shed and the disk-type beat-up motion, the weft thread is propulsed by the carriers and advanced to the fell of the cloth along a line inclined towards the fell. As a result, by the moment the carrier emerges from the shed, in the extreme zone thereof there appears the excess amount of the weft thread which is determined as the difference between the length of the helical groove formed by the depressions in the disks and the width of the extreme zone. Therefore, for the normal process of the cloth formation a mechanism is required which will remove this excess amount of the weft thread from the extreme zone. Besides, the weaving practice has proven that the process of formation of the cloth edge is more stable (does not noticeably differ from the process of formation of the cloth body), if the end of the weft thread is kept taut till the end of the cloth formation process, across the entire weaving width.

When used for this purpose are the known grips stationary mounted at the exit of the carriers from the travelling-wave shed only gripping and holding of the weft thread are ensured, whereas, due to structural features of these grips, the removal of the excess amount of the weft thread under a definite tension required for producing a high-quality cloth is unattainable.

At present, there is known an apparatus for gripping the weft thread disposed next to the butt surface of the shaft of the disk-type beat-up motion at the exit of the weft thread carriers from the looming-up zone, i.e. from the traveling-wave shed and intended for gripping the weft thread behind the carrier, conveying it towards the fell of the cloth and keeping it taut by way of compensating for an excess length of the weft thread till the latter is interlaced with the warp threads of the cloth.

This apparatus includes gripping members one of which is installed displaceably relative to the other one for the weft thread to be thereby gripped. The gripping member installed stationary is made as a plate secured on the loom frame, whereas the movable gripping member is made as a bush with an engaging tooth rotating in the same direction with the disk-type beat-up motion.

The rotatable bush and the stationary plate are tightened together by a spring. In the process of gripping of the weft thread, the tooth brings the end of the weft thread to the stationary plate and, due to the mutual friction, the gripping occurs. With the engaging tooth going on displacing relative to the stationary plate, due to different coefficients of friction of the stationary plate and the tooth, the weft thread is placed under tension, i.e. the excess amount of the weft thread is withdrawn from the shed. The thread is kept taut as long as the engaging tooth interacts with the profile of the stationary plate.

However, since this apparatus depends for its operation on the friction between the thread, the stationary and the movable gripping members and also due to the lengthwise irregularity of the weft thread, the tensioning and holding thereof is unstable and deficient.

Besides, the abilities of this device to apply tension to the end of the weft thread are limited.

It is an object of the present invention to obviate the disadvantages.

The principal object of the present invention is to provide a weft thread gripping mechanism for a loom with a travelling-wave shed and a disk-type beat-up motion which should make it possible, after the weft thread is gripped and while it is transferred to the fell of the cloth, to keep it taut till it gets interlaced with the warp threads.

Another object of the present invention is to provide a weft thread gripping mechanism for a loom with a travelling-wave shed which should make it possible to improve the process of formation of the edge of the cloth.

One more object of the present invention is to produce a high-quality cloth.

BRIEF DESCRIPTION OF THE INVENTION

This and other objects are attained by that in a weft thread gripping mechanism for a loom with a travelling-wave shed and a disk-type beat-up motion including gripping members elastically tightened together and installed at the side of exit of the weft thread carriers from the travelling-wave shed, with one of the gripping members installed so as to be displaceable relative to the other one to thereby form a gap therebetween for the weft thread to pass through, in accordance with the invention, the gripping members are mounted on a shaft of the disk-type beat-up motion so as to be rotatable therewith and be displaceable, after gripping the weft thread, lengthwise the axis of the shaft in the direction from the travelling-wave shed, a stationary stop being secured to the very same shaft for cooperating with the movable gripping members at the moment of the closest approach of the gripping members to the travelling-wave shed for said gap to be formed therebetween.

Arrangement of the gripping members on the shaft of the disk-type beat-up motion allows to shift the gripped end of the weft thread in step with the movement thereof towards the fell of the cloth. In addition, due to the displacement of the gripping members lengthwise the shaft axis, it is possible to transfer the gripped end of the weft thread in the direction from the looming-up zone thus removing the excess amount of the weft thread from the extreme zone of cloth formation and bringing the gripping members to the looming up zone as close as possible for seizing the weft thread.

According to the invention, the gripping members are mounted on the shaft of the disk-type beat-up motion with the aid of a doble-arm lever pivotable in the plane parallel to the axis of the shaft of the disk-type beat-up motion from a stationary cam installed on a frame of the loom coaxially with the shaft of the disk-type beat-up motion, one arm of the lever being provided with a roller constantly contacing the stationary cam, the other arm serving as a stationary gripping member in contact with the movable gripping member secured to the same arm of the lever through a spring-loaded rod displaceable from a stationary stop.

It is preferable to mount the stationary stop and the axle of the double-arm lever on the shaft of the disk-type beat-up motion with the use of a bush rigidly secured on this shaft. This enables to secure all parts of the proposed weft thread gripping mechanism on the shaft of the disk-type beat-up motion in a simplest way without modifying the shaft itself, which, in turn, makes it possible to quickly and easily place this weft thread gripping mechanism in service on the already operating looms with the travelling-wave shed an the disk-type beat-up motion.

According to an alternative embodiment of the invention, the double-arm lever is elastically urged against the stationary cam, while the roller of the double-arm lever contacts the stationary cam over the butt surface thereof, due to which the excess amount of the weft thread may be removed from the extreme zone of cloth formation in compliance with the preset law without the profile of the butt surface of the stationary cam being changed.

It is preferable also to make the bush as a sleeve accommodating inside the stationary cam provided with a shaped slot to receive the roller of the double-arm lever, the axle of the roller passing through a hole made in the side surface of the bush.

According to another embodiment of the invention, the contact of the stationary stop with the spring-loaded rod occurs through an intermediate rotatable member with the axle of rotation mounted on the double-arm lever which makes it possible to seize the weft thread reliably and quickly.

According to still another embodiment of the invention, between the gripping members mounted on the shaft of the disk-type beat-up motion and the travelling-wave shed, along an imaginary line forming a continuation of the fell of the cloth, on the loom frame, arranged are an additional gripping pair of jaws for nipping the weft thread forced to the fell of the cloth and held by the gripping members, and a cutter for severing the weft thread held by the additional gripping pair of the jaws and the gripping members, the shaft of the disk-type beat-up motion being outfitted with a profiled cam contacting, via the roller, with a movable blade of the cutter and the movable jaw of the gripping pair for the displacement thereof. This enables to hold the end of the weft thread taut till the end of the cloth-forming process across the entire weaving width.

The movable jaw of the gripping pair and the movable blade of the cutter are preferably placed on a common axle and elastically pressed against the profiled cam via a spring-loaded bell-crank lever mounted on the loom frame due to which the additional gripping pair and the cutter may be controlled by one and the same cam.

Thus, the proposed weft thread gripping mechanism makes it possible to improve the process of the cloth formation and to enhance the quality of the produced cloth.

DETAILED DESCRIPTION OF THE INVENTION

Given below is a detailed description of the invention with reference to the accompanying drawings, wherein.

Figure 4:
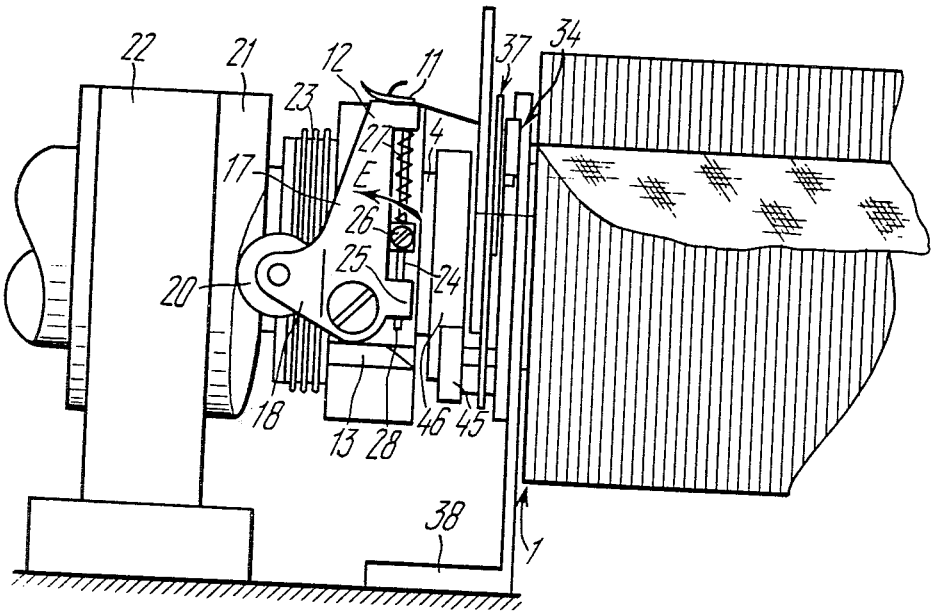
FIG. 4 is a schematic view of the weft thread gripping mechanism outfitted with an additional gripping pair of jaws and a cutter disposed intermediate of the gripping members and the travelling-wave shed.
Figure 5:
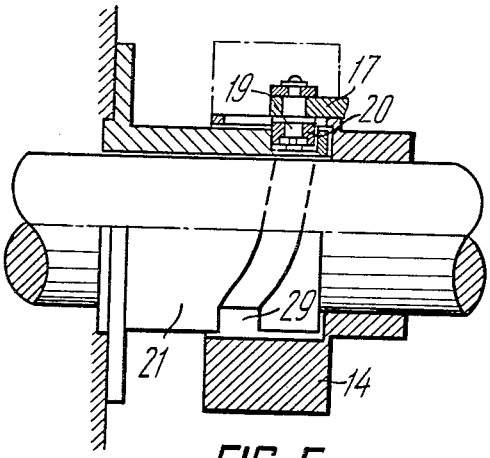
FIG. 5 shows a bush of the weft thread gripping mechanism located on the shaft of the disk-type beat-up motion, and a stationary cam accommodated therewithin, longitudinal section.
Figure 6:
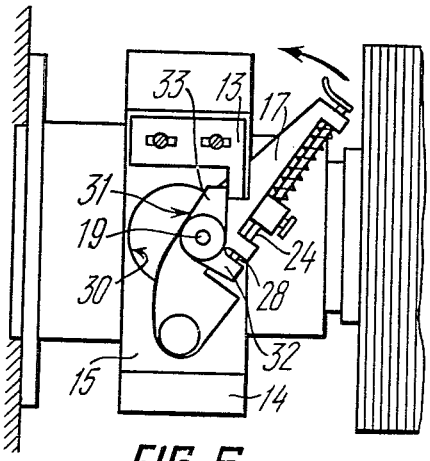
Figure 7:
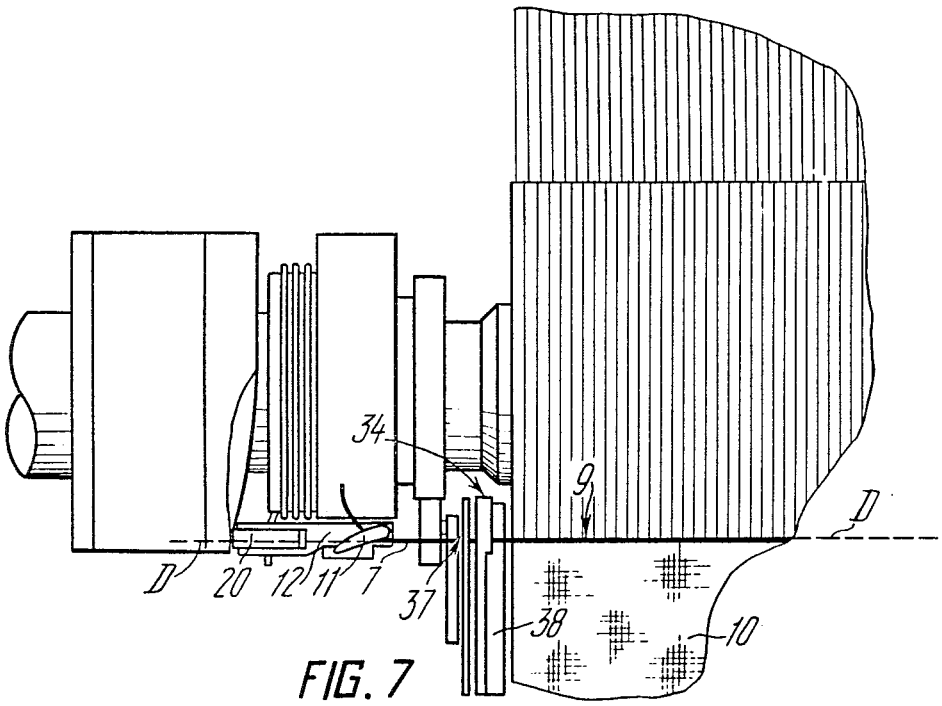
Figure 9:
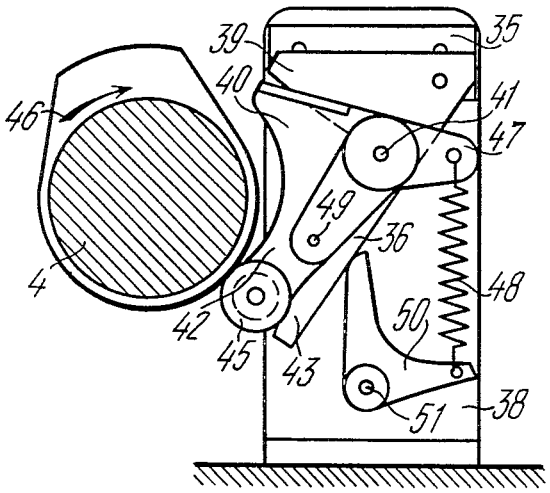
Figure 8:
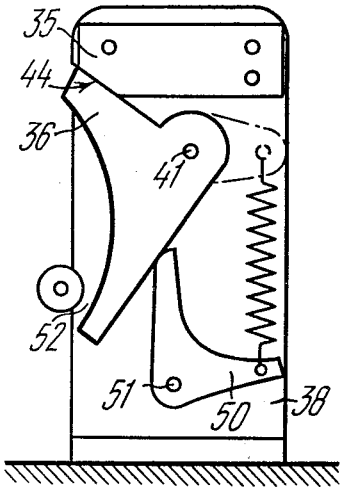

FIG. 6 same as in FIG. 5, top view;

FIG. 7 same as in FIG. 4, in a position when the gripping members are arranged along the same line with the additional gripping pair of the jaws and the cutter, top view;

FIG. 8 shows schematically the jaws of the additional gripping pair;

FIG. 9 shows schematically the cutter elastically urged against the profiled cam.

The proposed weft thread gripping mechanism is employed in the known looms with a travelling-wave shed A and a disk-type beat-up motion 1. Since the structure of the weft thread gripping mechanism is not governed by the structure of the loom, the structure of weft thread carriers 2 and the structure of apparatus 3 for propelling the carriers 2 in the travelling-wave shed A, they are neither dealt with in the description nor shown in the drawings because used as these apparatus may be any apparatus known in the art which serve this purpose when used in the loom.

Figure 1:
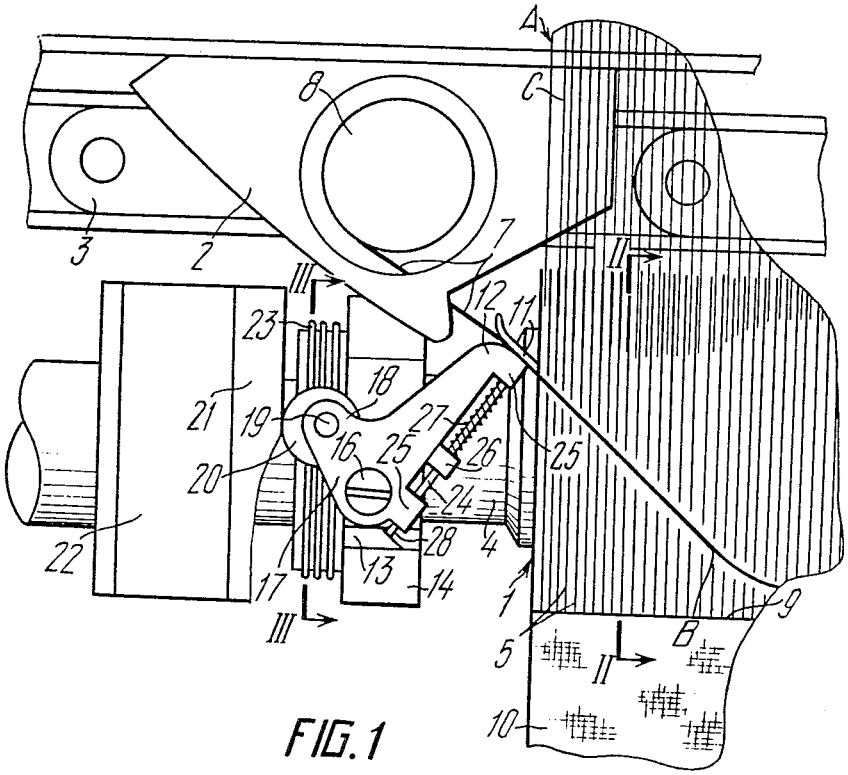
FIG. 1 is a partial schematic representation of a weft thread gripping mechanism placed at the side of exit of carriers from a travelling-wave shed, top view.
Figure 2:
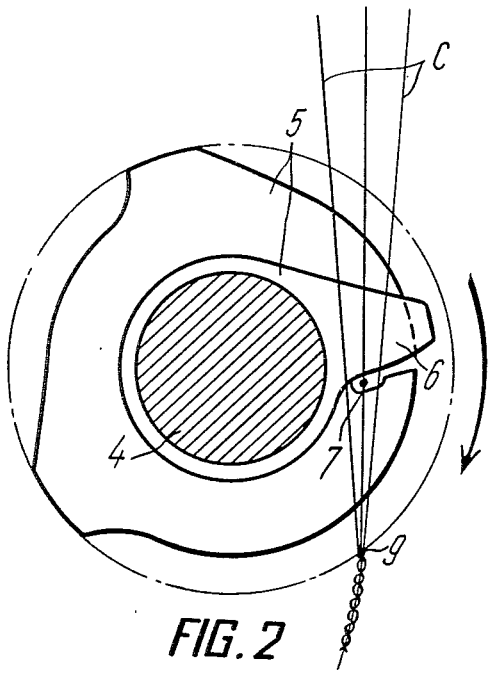
FIG. 2 is a section along line II—II of FIG. 1.

The disk-type beat-up motion 1 includes a drive shaft 4 whereon secured are disks 5 with teeth 6 (FIG. 2). The disks 5 (FIG. 1) are secured on the shaft 4 with a shift, whereby the crests of the teeth form helical surfaces B which engage a weft thread 7 unwound from a spool 8 of the carrier, advance it to a fell 9 of a cloth 10 and force it thereto (in FIG. 1 the helical surface B in plan is aligned with the weft thread 7).

The weft thread gripping mechanism is installed at the side of exit of the weft thread carriers 2 from the travelling-wave shed A, i.e. from a looming-up or weaving zone C, and includes gripping members 11 and 12 elastically tightened together, one of these members, for instance, the gripping member 11, being installed so as to be displaceable relative to the gripping member 12 for a gap accommodating the weft thread 7 to be thereby formed therebetween. Therefore, the gripping member 11 will be subsequently referred to as the movable gripping member 11. The gripping members 11 and 12 are mounted on the shaft 4 of the disk-type beat-up motion 1 so as to be rotatable therewith and displaceable lengthwise the axis of the shaft 4 in the direction from the travelling-wave shed A. Secured on the same shaft 4 is a stationary stop 13 adapted to cooperate with the movable gripping member 11 at the moment of the closest approach of the gripping members 11 and 12 to the travelling-wave shed A for a gap to be formed therebetween.

Figure 3:
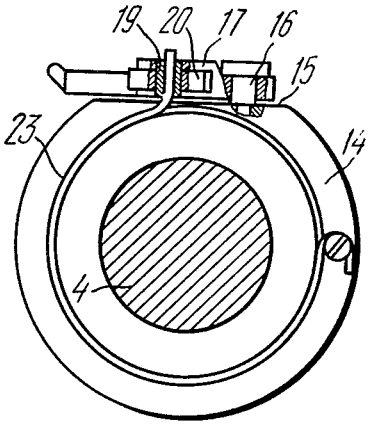
FIG. 3 is a section along line III—III of FIG. 1.

For convenience in installation of the gripping members 11 and 12 on the shaft 4 rigidly secured to the latter by any known manner is a bush 14 provided with a flat surface 15 (FIG. 3). On this bush 14, on the side of the flat surface 15 secured with the aid of an axle 16 is an L-shaped double-arm lever 17 (FIG. 1). On one arm 18 of the double-arm lever 17, through the medium of an axle 19, secured is a freely rotating roller 20, the second arm of this lever being provided with a flat portion and serving as the gripping member 12.

The double-arm lever 17 is pivotable about the axle 16 and the pivoting occurs in the plane parallel to the axis of the shaft 4 above the flat surface 15 (FIG. 3) due to a stationary cam 21 (FIG. 4) installed on a frame 22 of the loom coaxially with the shaft 4 of the disk-type beat-up motion 1. The profiled surface of the stationary cam 21 is in constant contact with the roller 20 of the double-arm lever 17. For this, the double-arm lever 17 is elastically urged against the stationary cam 21 by a spring 23 one end of which is attached to the butt of the bush 14 (FIG. 3) and the other, to the axle 19 of the roller 20, as is shown in FIG. 3.

The second arm of the double-arm lever 17 (FIGS. 1 and 4) mounts the movable gripping member 11 made as a lug with the lower flat surface arranged parallel to the gripping member 12, i.e. to the flat portion of the second arm of the double-arm lever 17. For this, the gripping member 11 is secured to the end of a rod 24 which passes through guides 25 on the double-arm lever 17 running along the second arm thereof. The rod 24 carries a slide block 26 and a spring 27, one end of the spring 27 bearing against the slide block 26 and the other, against the guide 25 which renders the rod 24 spring-loaded. This spring 27 elastically tightens together the gripping member 11 and the gripping member 12.

The rod 24 is placed in the guides 25 so that its end 28 protrudes therefrom, as is shown in FIGS. 1 and 4. This being the case, this protruding end 28 of the rod interacts with the stationary stop 13 to remove the gripping member 11 away from the gripping member 12. Due to such an arrangement of the gripping members 11 and 12, with the double-arm lever 17 turning, the gripping members 11 and 12, depending upon the profile of the stationary cam 21, either recede from, or advance to, the travelling-wave shed.

The profiled surface of the stationary cam 21 represents a butt surface of this cam, as is shown in FIGS. 1 and 4, due to which the roller 20 of the double-arm lever 17 is in contact with the butt surface of the stationary cam. However, the profiled surface of the stationary cam 21 may be made as a shaped slot 29, as is shown in FIG. 5, on a cylindrical surface of the cam 21. In this case, the bush 14 is made as a sleeve with the stationary cam 21 placed therein. The shaped slot 29 of the cam 21 accommodates the roller 20 of the double-arm lever 17, with the axle 19 of the roller 20 passing through a hole 30 (FIG. 6) made at the side of the flat 5 in the side surface of the bush 14.

With the stationary cam 21 placed inside the bush 14, it is preferable that the double-arm lever 17 be shaped so as is shown in FIG. 6 and the contact of the stationary stop 13 with the spring-loaded rod 24 be attained via an intermediate rotatable member 31 with a rotational axle mounted on the double-arm lever 17 and combined with the axle 19 of the roller 20.

Thereat, the rotatable member 31 (FIG. 6) has two arms 32 and 33, the arm 32 cooperating with the end 28 of the rod 24 and the arm 33, with the abutment of the stationary stop 13.

Intermediate of the travelling-wave shed A (FIG. 7) and the gripping members 11 and 12 mounted on the shaft 4 of the disk-type beat-up motion 1, along an imaginary line D forming a continuation of the fell 9 of the cloth 10, there are located an additional gripping pair 34 of jaws 35 (FIG. 8) and 36 and a cutter 37 (FIG. 7).

The additional gripping pair 34 of the jaws and the cutter 37 are secured to a bracket 38 (FIG. 4) of the loom frame, the additional gripping pair 34 of the jaws being designed for gripping the weft thread 7 forced to the fell 9 of the cloth 10 and held by the gripping members 11 and 12, with the cutter 37 adapted to sever the weft thread nipped by the additional gripping pair 34 of the jaws and the gripping members 11 and 12.

The jaw 35 (FIG. 8) of the gripping pair 34 and a blade 39 (FIG. 9) of the cutter 37 are rigidly secured on the bracket 38 and are stationary.

Since the jaw 36 of the gripping pair 34 and a blade 40 of the cutter 37 are freely seated on a common axle 41 attached to the bracket 38 due to which they are allowed to turn about the axle 41, the jaws 36 and the blade 40 will be hereinafter referred to as movable.

The movable blade 40 and the jaw 36 have the elongated shape, as is shown in FIGS. 8 and 9, terminating in abutments 42 and 43, respectively.

The jaw 35 (FIG. 8) has a beveled 44 which allows a reliable contact of the jaw 35 over the beveled 44 with the appropriate portion of the jaw 36 so that gripping the weft thread is provided.

The abutment 42 (FIG. 9) of the blade 40 carries a roller 45 which is free to rotate. The axle mounting roller 45 extends across the plane of abutment 43.

The blade 40 and the jaw 36 are caused to rotate by a profiled cam 46 attached to the shaft 4 of the disk-type beat-up motion and located nearer to the travelling-wave shed than the gripping members 11 and 12, as is shown in FIGS. 4 and 7. The profiled cam 46 (FIG. 9) is in constant contact with the roller 45 of the blade 40. For this, the rotatable blade 40 is elastically urged against the profiled cam 46 by a bell crank lever 47 and a tension spring 48. In this case, the bell crank lever 47 is seated on the axle 41 and one arm thereof is coupled, via a pin 49, with the blade 40 of the cutter, while the other arm, with the tension spring 48 the other end of which is attached to a bell crank lever 50.

The bell crank lever 50 is secured pivotably on an axle 51 available on the bracket 38 and intended for elastically tightening together the jaws 36 and 35. With the jaw 36 elastically urged against the jaw 35 (FIG. 8), between the abutment 43 and the axle of the roller 45 formed is a gap 52 ensuring the intimate contact of the jaws over the bevel 44 as well as the successive closing of the additional gripping pair 34 and the cutter 37.

The weft thread gripping mechanism operates as follows.

With the carriers 2 (FIG. 1) flying along the travelling-wave shed, unwound from the spools 8 of each of the carriers is the weft thread 7 which, nearby the rear wall of the carrier 2, is engaged by the teeth 6 of the disks 5 of the disk-type beat-up motion 1 and, with the shaft 4 rotating, these teeth 6 transfer the weft thread towards the fell 9 of the cloth thereby beating up the weft thread (the process of propulsing and beating up the weft thread being well known, it is not dealt with in the present description). As the carrier 2 emerges from the travelling-wave shed A, the gripping members 11 and 12 available on the double-arm lever 17, rotating together with the shaft 4 and disposed at the moment as close as possible to the travelling-wave shed come under the weft thread 7. As this takes place, the end 28 of the rod 24 rests against the stationary stop 13, while the gripping member 11 is backed away from the gripping member 12 so that a gap is formed therebetween and, at the next moment of rotation of the shaft 4, the weft thread 7 enters this gap, since the weft thread blocks the way of the moving gripping members 11 and 12.

The double-arm lever 17 (FIG. 4), therewith, acted upon by the spring 23 and the stationary cam 21 which is in permanent contact with the roller 20 of the double-arm lever 17, starts turning in the direction shown by an arrow E in which the gripping members 11 and 12 recede from the looming-up zone, i.e. from the travelling-wave shed. The end 28 of the rod 24 leaves the stop 13 and under the action of the spring 27 the gripping member 11 is urged against the gripping member 12 thereby gripping the weft thread seized by them.

Now, the double-arm lever 17, while continuing rotating together with the shaft 4 and pivoting under action of the spring 23, removes the excess amount of the weft thread from the looming-up zone. Before the position of the weft thread withdrawn from the warp threads coincides with the imaginary line D (FIG. 7) forming the continuation of the fell 9 of the cloth 10, the cutter 37 and the jaws 35 and 36 of the additional gripping pair 34 open. To this end, the profiled cam 46 (FIG. 9) rotating together with the shaft 4, exerts pressure on the roller 45 and causes the movable blade 40 of the cutter to turn relative to the axle 41 and the stationary blade 39. As the roller 45 goes on displacing under action of the cam 46, the axle thereof approaches the abutment 43 of the movable jaw 36, turns this jaw 36 with respect to the axle 14 and makes it move away from the stationary jaw 35.

At the next moment of rotation of the shaft 4, the weft thread 7 nipped at one end by the gripping members 11 and 12 proves to be on one line with the fell 9 of the cloth 10, i.e. coincides with the line D, enters the gaps between the jaws 35 and 36 of the additional gripping pair and the blades 39 and 40 of the cutter 37.

Next, in accordance with the change of the profile of the cam 46, the roller 45 departs from the abutment 43 of the movable jaw 36 and the latter, while being acted upon by the bell crank lever 50 and the spring 48, turns and causes the weft thread to urge against the jaw 35. Thereafter, the movable blade 40, under the action of the bell crank lever 47 and the spring 48, turns and cuts the weft thread nipped by the jaws 35 and 36 of the additional gripping pair 34 and the gripping members 11 and 12.

Following this, in accordance with the change of the profiled surface of the stationary cam 21, the double-arm lever 17 starts turning in the reverse direction, thereby approaching the looming-up zone. As the double-arm lever 17 turns, the end 28 of the rod 24 starts interacting with the stationary stop 13, the spring 27 compresses and the gripping member 11 departs from the gripping member 12, whereby the cut-off end of the weft thread is released and the gripping members 11 and 12 prove to be ready for seizing the next weft thread brought by the carrier emerging from the shed.

The whole process described above takes place while the shaft 4 makes one revolution. Then, the cycle repeats itself.

What is claimed is:

1. A weft thread gripping mechanism for a loom with a travelling-wave shed, a disk-type beat-up motion provided with a shaft and forcing the weft thread to a fell of a cloth, and with weft thread carriers propelled through the travelling-wave shed, comprising: two gripping members elastically tightened together and installed at the side of exit of the weft thread carriers from the travelling-wave shed, one of said gripping members being stationary and the other one, movable and installed so as to be displaceable relative to the stationary gripping member for forming a gap therebetween into which the weft thread from the carrier is received, said gripping members being mounted on the shaft of the disk-type beat-up motion so as to be rotatable therewith and displaceable, after gripping the weft thread, lengthwise the axis of the shaft of the disk-type beat-up motion in the direction from the travelling-wave shed; a means for said displacement of said gripping members lengthwise the axis of the shaft of the disk-type beat-up motion as a result of which the gripping members may be moved away from or brought as close as possible to the travelling-wave shed; a stationary stop secured on the shaft of the disk-type beat-up motion and cooperating with the movable gripping member at the moment of the closest approach of the gripping members to the travelling-wave shed, whereby the displacement of the movable gripping member relative to the stationary gripping member for said gap to be formed therebetween is achieved.

2. A mechanism as claimed in claim 1, wherein there is provided a double-arm lever pivotable in the plane parallel to the axis of the shaft of the disk-type beat-up motion, mounted on the shaft of the disk-type beat-up motion and carrying said gripping members, one arm of this double-arm lever serving as the stationary gripping member in contact with the movable gripping member; a stationary cam installed coaxially with the shaft of the disk-type beat-up motion on a frame of a loom; a roller placed on the other arm of said double-arm lever and permanently contacting said stationary cam, whereby this stationary cam is converted into a means for pivoting the double-arm lever in the plane parallel to the axis of the shaft and for displacing said gripping members along the axis of the shaft; a spring-loaded rod installed so as to be displaceable from said stationary stop and fitted on the arm of the double-arm lever serving as the stationary gripping member, with the movable gripping member secured on said spring-loaded rod; guides provided on said double-arm lever to receive the spring-loaded rod for the latter to be displaceable from the stationary stop.

3. A mechanism as claimed in claim 2, wherein on the shaft of the disk-type beat-up motion there is secured a bush mounting said stationary stop and an axle of rotation for said double-arm lever.

4. A mechanism as claimed in claim 2, wherein said double-arm lever is elastically urged against said stationary cam, whereas said roller of the double-arm lever contacts the stationary cam over the butt surface thereof.

5. A mechanism as claimed in claim 3, wherein said bush includes a sleeve accommodating inside thereof said stationary cam; a shaped slot being provided in said stationary cam to accommodate said roller of the double-arm lever, an opening being formed in the sleeve of said bush for the axle of said roller to pass through.

6. A mechanism as claimed in claim 2, wherein said double-armed lever is outfitted with an intermediate rotatable member with a rotational axle mounted thereon, said member providing contact between said spring-loaded rod and said stationary stop for displacing the spring-loaded rod.

7. A mechanism as claimed in claim 1, wherein there are provided an additional gripping pair of jaws and a cutter located on the frame of the loom between the travelling-wave shed and said gripping members along an imaginary line forming a continuation of a fell of a cloth, said additional gripping pair of the jaws being intended for gripping the weft thread forced to the fell of the cloth by the disk-type beat-up motion and held by said gripping members and made up of the movable and stationary jaws, said cutter being adapted to sever the weft thread nipped by said additional gripping pair of the jaws and said gripping members, and made up of movable and stationary blades; a profiled cam secured on the shaft of the disk-type beat-up motion; a roller through which the movable blade of said cutter and the movable jaw of said additional gripping pair prove to be in permanent contact with said profiled cam.

8. A mechanism as claimed in claim 7, wherein the movable blade of said cutter and the movable jaw of said additional gripping pair are arranged on a common axle mounted on the frame of the loom, a bell crank lever mounted on the frame of the loom being used to elastically urge the movable jaw and the movable blade against said profiled cam.

* * * * *